US007536887B2

(12) United States Patent
Makino

(10) Patent No.: US 7,536,887 B2
(45) Date of Patent: May 26, 2009

(54) CYLINDER LOCK

(75) Inventor: Toshikazu Makino, Hiroshima (JP)

(73) Assignee: U-Shin Ltd., Tokyo (JP)

( * ) Notice: Subject to any disclaimer, the term of this patent is extended or adjusted under 35 U.S.C. 154(b) by 463 days.

(21) Appl. No.: 10/595,098

(22) PCT Filed: Aug. 31, 2004

(86) PCT No.: PCT/JP2004/012521

§ 371 (c)(1),
(2), (4) Date: Feb. 13, 2006

(87) PCT Pub. No.: WO2005/026476

PCT Pub. Date: Mar. 24, 2005

(65) Prior Publication Data

US 2008/0168814 A1 Jul. 17, 2008

(30) Foreign Application Priority Data

Sep. 12, 2003 (JP) ..... 2003-321457

(51) Int. Cl.
*E05B 17/04* (2006.01)

(52) U.S. Cl. ..... 70/379 R; 70/370; 70/371; 70/466

(58) Field of Classification Search ..... 70/379 R, 70/367–371, 380, DIG. 66, 466, 373–375
See application file for complete search history.

(56) References Cited

U.S. PATENT DOCUMENTS 3,287,944 A * 11/1966 Crumb ..... 70/495
5,134,871 A * 8/1992 Makino et al. ..... 70/492
5,428,978 A * 7/1995 Tsukano ..... 70/386
5,640,864 A * 6/1997 Miyamoto ..... 70/379 R
5,732,580 A * 3/1998 Garnault et al. ..... 70/422
5,775,147 A * 7/1998 Wittwer ..... 70/379 R (Continued)

FOREIGN PATENT DOCUMENTS

JP 4-198569 7/1992

(Continued)

*Primary Examiner*—Patricia L Engle
*Assistant Examiner*—Kristina R Fulton
(74) *Attorney, Agent, or Firm*—Wenderoth, Lind & Ponack, L.L.P.

(57) ABSTRACT

A cylinder lock has a cylindrical sleeve in which lock grooves are formed on an inner circumferential surface, a cylindrical cylinder on which a plurality of tumbler insertion holes are formed, a plurality of tumblers which are engaged with the lock grooves in an advanced position and which are retracted and disengaged from the lock grooves with insertion of an authorized key, a rear rotor of which at least a portion is turnably placed in the cylinder and in which a container portion is formed in the portion placed in the cylinder, a connecting member which is placed in the container portion of the rear rotor and which is movable in radial directions between a connected position in which the rear rotor and the cylinder are connected to each other and a non-connected position, and a connection releasing member positioned on an outer circumference of the connecting member and is movable in radial directions relative to the sleeve. The connection releasing member travels radially and presses and moves the connecting member to the non-connected position when the sleeve that receives a turning force of the cylinder by virtue of engagement of the tumblers turns relative to the holder.

16 Claims, 7 Drawing Sheets

U.S. PATENT DOCUMENTS 6,058,751 A * 5/2000 Dimig et al. ..... 70/419
6,105,405 A * 8/2000 Westwinkel ..... 70/371
6,109,080 A * 8/2000 Chen et al. ..... 70/371
6,644,076 B2 * 11/2003 Huang ..... 70/379 R
6,837,083 B2 * 1/2005 Katagiri et al. ..... 70/379 R
6,978,645 B2 * 12/2005 Shimon ..... 70/379 R
6,978,647 B2 * 12/2005 Edwards et al. ..... 70/495
2002/0073754 A1 * 6/2002 Katagiri et al. ..... 70/379 R
2007/0234768 A1 * 10/2007 Yamaguchi et al. ..... 70/379 R

FOREIGN PATENT DOCUMENTS

JP 3076920 6/2000
JP 3380611 12/2002

* cited by examiner

CYLINDER LOCK

BACKGROUND OF THE INVENTION

The present invention relates to a cylinder lock that is used for doors of vehicles, buildings and the like, and particularly relates to a cylinder lock that cannot be unlocked, by slipping of a cylinder, in the event that a screwdriver, an unauthorized key or the like is inserted and is forcibly turned.

In this type of cylinder lock, insertion of an authorized key into a cylinder including tumblers engaged with lock grooves formed in a sleeve causes the tumblers to be drawn into the cylinder and allows the cylinder to be turned to a locked position or an unlocked position. The cylinder lock, however, may improperly be unlocked with the tumblers destroyed in event that a screwdriver, an unauthorized key or the like is inserted into the cylinder and is forcibly turned, even though the tumblers are engaged with the lock grooves of the sleeve.

There have conventionally been proposed cylinder locks having a configuration in which a cylinder is freely turned (slipped) together with a sleeve relative to a holder on occasion of such improper unlocking. Prior art associated with this type of the cylinder lock is hereinafter described.

[Patent Document 1] JP 3076920 B

[Patent Document 2] JP 3380611 B

In Patent Document 1 is disclosed a cylinder lock in which a sleeve, a cam body, and a clutch mechanism are provided between a holder and a cylinder. The sleeve is provided between the holder and the cylinder so that the sleeve is capable of turning in circumferential directions and advancing and retreating in axial directions. In the sleeve are formed lock grooves with which a plurality of tumblers provided in the cylinder are engaged. On an inner circumferential surface of the sleeve is formed a ring groove into which a protruded portion provided on the cylinder is rotatably inserted. The cam body makes the sleeve advance or retreat with a turn of the sleeve. The clutch mechanism has a joint member in pressure contact with an end of the sleeve on the advancing side, connects the cylinder to the rear rotor with displacement of the joint member that is caused by retreat of the sleeve, and positions the protruded portion of the cylinder in the ring groove of the sleeve. The clutch mechanism disconnects the cylinder from the rear rotor with displacement of the joint member that is caused by advancement of the sleeve, and positions the protruded portion of the cylinder in the lock grooves of the sleeve. In the event that unlocking of the cylinder lock is attempted with use of tools such as an unauthorized key and a screwdriver, the clutch mechanism is switched to a disconnected state with advancement of the sleeve. Thus the force applied to the cylinder is not transmitted to the rear rotor, and a locked state is maintained. Also, a lock plate and the lock grooves are not destroyed by a forcible turn of the cylinder because the protruded portion of the cylinder advances into the lock grooves of the sleeve with the advancement of the sleeve.

In Patent Document 2 is described a cylinder lock in which a sleeve, a cylinder, tumblers, a driving member, a latch member, a release member and a spring are provided in a holder. The latch member is provided in the cylinder so as to be movable between an engaged position in which the cylinder and the driving member are connected and a separated position in which the connection is released. The release member is provided in the sleeve so as to be movable in radial directions, is generally shaped like a letter "U," and moves the latch member to the separated position when the sleeve is turned relative to the holder. The spring presses the release member relative to the holder. On the release member is formed a protrusion that is to engage with a recess formed in the holder. When the sleeve is turned relative to the holder, the protrusion of the release member moves from the recess of the holder and the release member moves inward in a radial direction. Thus unlocking cannot be achieved with use of an unauthorized key because the latch member pressed by the moving release member moves in the radial direction and because the connection between the latch member and the driving member is released. That is, the use of an unauthorized key holds the driving member in a stationary state and causes the cylinder to turn. Therefore, a cylinder lock having a great resistance to destruction is obtained.

The cylinder lock disclosed in Patent Document 1, however, is configured so that a turn with an unauthorized key causes rearward movement of the sleeve with respect to the axial direction and slip of the cylinder, thereby preventing unlocking. a problem in that increase in a total length of the holder involves increase in the size of the cylinder lock as a whole.

The cylinder lock that is disclosed in Patent Document 2 and that performs the movement of the release member in the radial directions, thus the total length can be reduced in comparison with the cylinder lock disclosed in Patent Document 1. This cylinder lock, however, is increased in size, as a matter of course, because both the sleeve that is selectively connected to the cylinder and the driving member are positioned outside the cylinder and because the latch member and the release member are therefore required to be placed at a given interval with respect to the axial directions. In addition, the cylinder lock has a problem in that the mechanism for connecting the latch member and the release member complicates the structure and assembly of the cylinder lock.

SUMMARY OF THE INVENTION

An object of the present invention is to provide a cylinder lock of a simple configuration and reduced size.

In order to achieve the above object, the cylinder lock according to the present invention comprises:

a cylindrical sleeve which is turnably placed in a holder and in which lock grooves are formed on an inner circumferential surface;

a cylindrical cylinder which is turnably placed in the sleeve and on which a plurality of tumbler insertion holes extending in a direction orthogonal to an axial direction are formed;

a plurality of tumblers which are reciprocally placed in the tumbler insertion holes of the cylinder, which are engaged with the lock grooves in an advanced position, and which are retracted and disengaged from the lock grooves with insertion of an authorized key;

a rear rotor of which an at least part is turnably placed in the cylinder and in which a container portion is formed in the part placed in the cylinder;

a connecting member which is placed in the container portion of the rear rotor and which is movable in radial directions between a connected position in which the rear rotor and the cylinder are connected to each other and a non-connected position; and a connection releasing member which is provided so as to be positioned on an outer circumference of the connecting member and so as to be movable in radial directions relative to the sleeve and which travels radially and presses and moves the connecting member to the non-connected position when the sleeve that receives a turning force of the cylinder by virtue of engagement of the tumblers with the lock grooves turns relative to the holder.

According to this configuration, when an authorized key is inserted into the cylinder in the cylinder lock, the tumblers retreat and sink into the cylinder. As a result, the cylinder is made turnable in the circumferential directions relative to the sleeve. Then the rear rotor connected through the connecting member to the cylinder is made turnable together with the cylinder relative to the sleeve because the connected state between the cylinder and the rear rotor is maintained. Thus an unlocking operation for the lock mechanism connected to the rear rotor can be carried out.

When a screwdriver, an unauthorized key or the like is inserted into the cylinder, some tumblers may retreat and sink into the cylinder by chance but not all. With a forcible turn in this state, the turning force of the cylinder is transmitted to the sleeve through engagement of the tumblers with the lock grooves of the sleeve, and the sleeve turns together with the cylinder relative to the holder. The rear rotor connected through the connecting member to the cylinder tends to turn integrally with the sleeve relative to the holder in synchronization with the turn of the cylinder because the connected state between the cylinder and the rear rotor is maintained. With this action, the connection releasing member provided in the sleeve moves radially inward and shifts the connecting member from the connected position to the non-connected position. Consequently, the connection between the cylinder and the rear rotor is released, so that the rear rotor connected to the lock mechanism cannot be turned by a turn of the cylinder. Therefore, slip of the cylinder prevents unauthorized unlocking.

In the cylinder lock of the present invention, preferably, a biasing member for biasing the connecting member toward the connected position is provided in the container portion of the rear rotor, and the connection releasing member is pressed through the connecting member by a biasing force of the biasing member and is fitted in a lock recess formed on an inner circumferential surface of the holder in a state prior to an unlocking operation with use of an authorized key.

Preferably, the container portion of the rear rotor is extended to a position in which the container portion is exposed from the cylinder to outside, a locking-portion through hole is provided in the exposed part of the container portion, and a locking portion that protrudes from the locking-portion through hole and locks a locked portion of the holder opposed thereto with the movement of the connecting member to the non-connected position that is caused by the connection releasing member is provided on the connecting member.

In the cylinder lock of the invention, the cylinder is provided between the sleeve and the rear rotor, the connecting member that is movable in the radial directions is provided in the container portion of the rear rotor, and the connection releasing member that presses and moves the connecting member to the non-connected position is provided on the outer circumference of the connecting member. That is, the connecting member and the connection releasing member are not required to be positioned at given intervals with respect to the axial direction. Accordingly, the total length of the cylinder lock and the size of the cylinder lock as a whole can be decreased. Besides, a structure thereof can be simplified in comparison with the cylinder lock disclosed in Patent Document 2 and thus improvement in work efficiency in assembling and cost reduction can be attained.

Furthermore, the connection releasing member is actuated by the biasing member that biases the connecting member. Thus a spring for biasing the connection releasing member is not required and the number of components can be reduced.

Besides, the locking portion that protrudes from the locking-portion through hole of the rear rotor and locks the locked portion of the holder opposed thereto with the movement of the connecting member to the non-connected position by the connection releasing member is provided on the connecting member. In event of unauthorized unlocking, therefore, the rear rotor can be brought into the locked state in which the rear rotor cannot be turned. In a slipping state in which unlocking of the cylinder lock of the invention installed in a vehicle, for example, is attempted with use of an unauthorized key or a screwdriver, a turn of the rear rotor with use of some tools inserted into a gap in a window or the like can reliably be prevented.

DESCRIPTION OF THE REFERENCE NUMERALS

10: holder, 15: lock recess portion, 17: sleeve, 18: lock groove, 20: installation hole, 21: cylinder, 23: tumbler insertion hole, 26: through hole, 27: tumbler, 32: rear rotor, 35: container portion, 38: paddle, 40: connecting member, 44: connection releasing member, 45: locked portion, 50: locking-portion through hole, 51: locking portion.

DETAILED DESCRIPTION OF THE PREFERRED EMBODIMENTS

Hereinbelow, embodiments of the present invention will be described with reference to the accompanying drawings.

Figure 1:
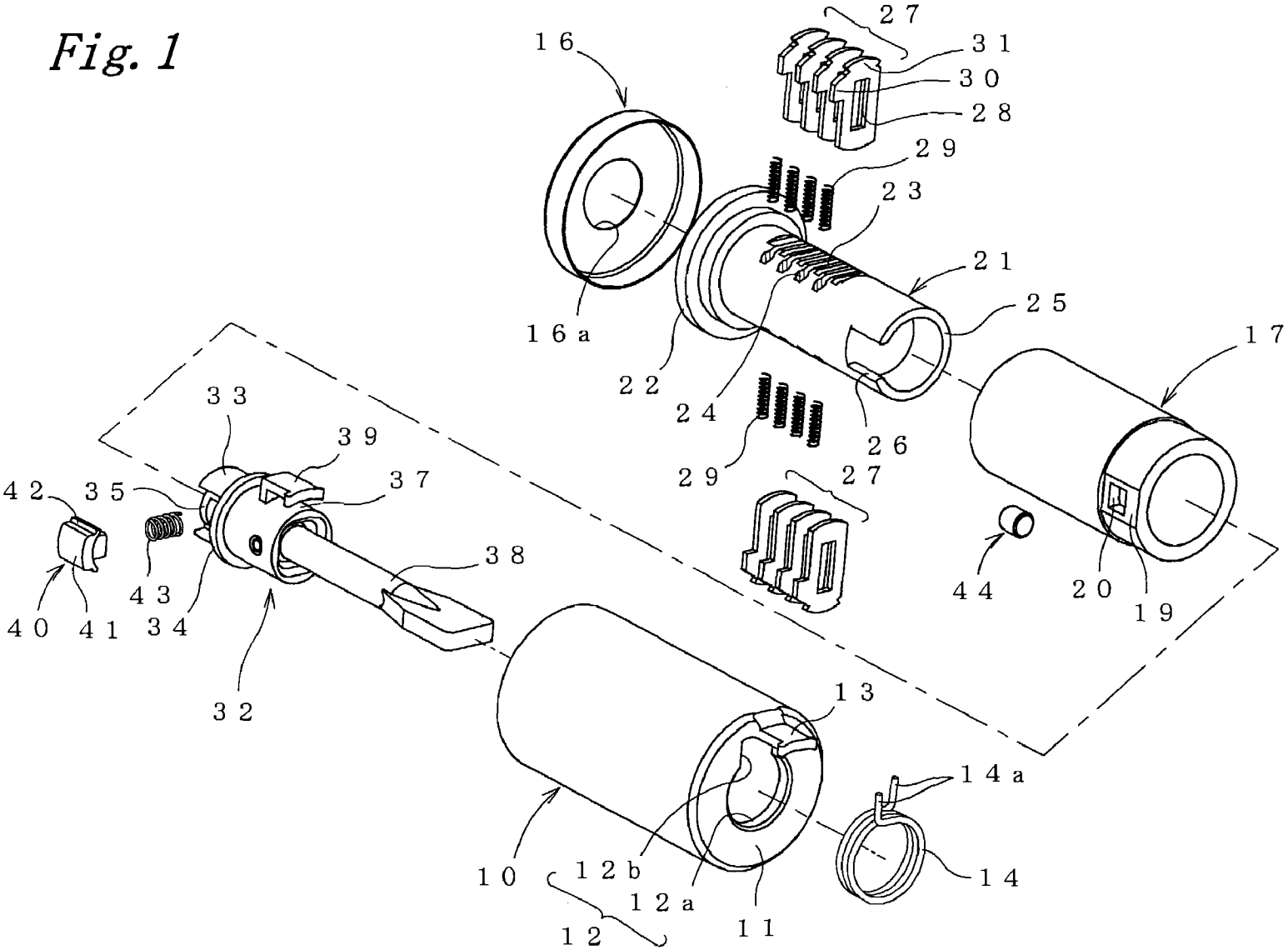
FIG. 1 is an exploded perspective view of a cylinder lock in accordance with a first embodiment of the invention.

FIG. 1 shows a cylinder lock in accordance with a first embodiment of the invention. The cylinder lock, which is fixed to a door of a vehicle, a building or the like, is generally composed of a holder 10, a sleeve 17, a cylinder 21, a plurality of tumblers 27, a rear rotor 32, a connecting member 40, and a connection releasing member 44.

Figure 2B:
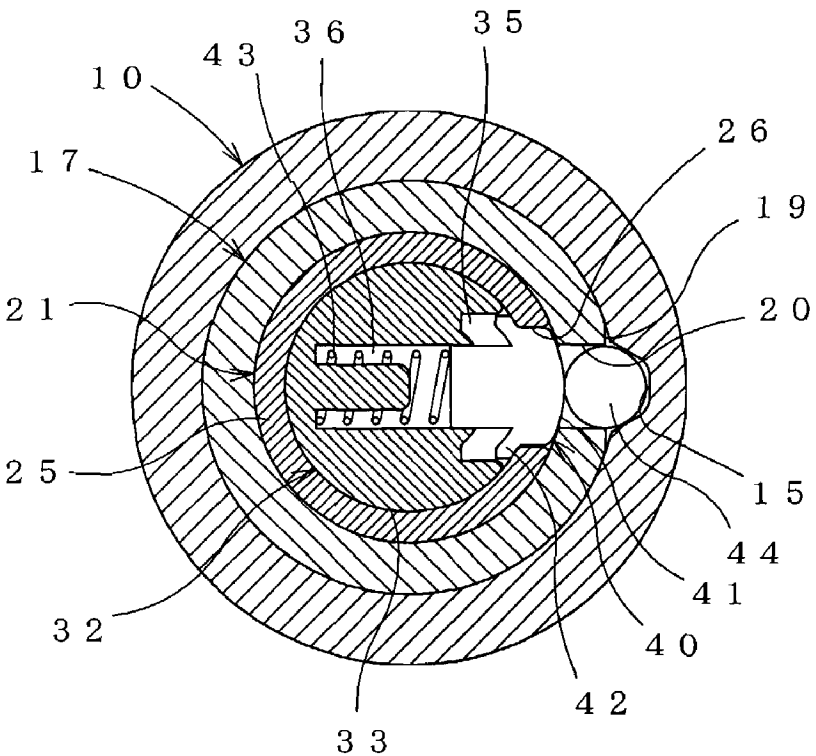
FIGS. 2A and 2B are sectional views of main parts of the cylinder lock.

The holder 10 is shaped like a cylinder so as to contain all components that constitute the cylinder lock. At one end of the holder 10 is provided a closed portion 11. In the closed portion 11 is formed an insertion hole 12 which is composed of a circular hole portion 12*a* and a rectangular hole portion 12*b*, into which a paddle 38 of the rear rotor 32 connected to a lock mechanism not shown and a spring engaging portion 39 are inserted, and which is shaped like a keyhole. A spring engaging portion 13 with which a spring 14 is to be engaged is provided outside the rectangular hole portion 12*b* of the insertion hole 12 with respect to radial directions so as to extend and protrude along and in parallel with an axial direction. The spring 14 is formed of wire wound helically and both ends 14*a*, 14*a* thereof are placed at both sides of the spring engaging portion 13. On an inner circumferential surface of the holder 10, as shown in FIG. 2B, a lock recess 15 in which the connection releasing member 44 that will be described later is to be fitted is formed in a position corresponding to the connection releasing member 44 in assembled state. The lock recess 15 is formed so that both side walls thereof expand toward an opening end. As shown in FIG. 1, a cover 16 having an opening 16*a* into which a key is to be inserted is fixed by crimping or the like to an end face of the holder 10 opposite to the closed portion 11.

Figure 2A:
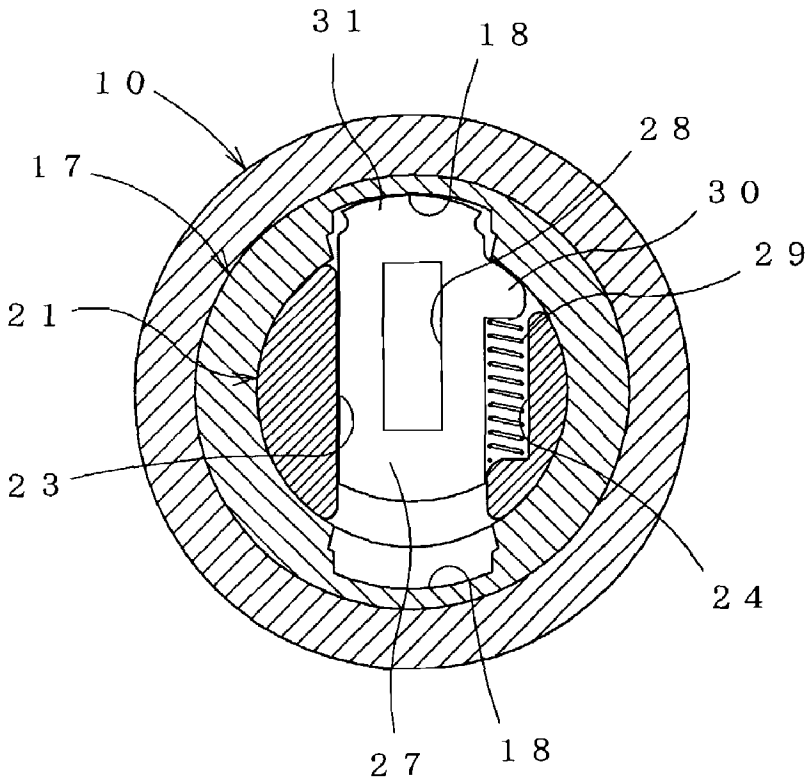

As shown in FIGS. 1 and 2A, the sleeve 17 is provided in the holder 10 so as to be capable of turning and is shaped like a cylinder. In symmetric positions on an inner circumferential surface of the sleeve 17, a pair of lock grooves 18 are provided so as to extend along the axial direction. Advancement and engagement of the tumblers 27 that will be described later into and with the lock grooves 18 disable the cylinder 21 from turning relative to the sleeve 17. A portion of an end of the sleeve 17 on a side where the rear rotor 32 that will be described later is mounted is chamfered in a rectangular shape. In the chamfered part 19 of the sleeve 17 is provided a rectangular installation hole 20 which communicates with an inner space, which corresponds to the lock recess 15 of the holder 10 in the assembled state, and in which the connection releasing member 44 that will be described later is movably installed. An opening length of the installation hole 20 in a circumferential direction is larger than a thickness thereof.

Figure 3B:
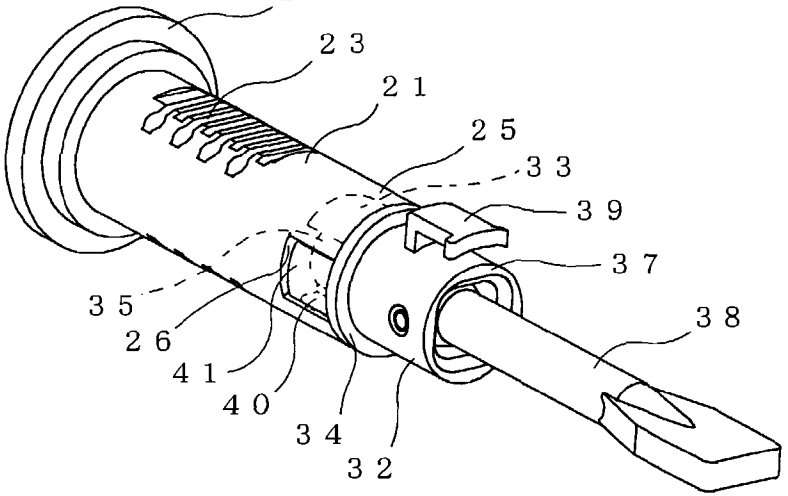
FIGS. 3A, 3B, and 3C are perspective views showing specified components that have been assembled.
Figure 3A:
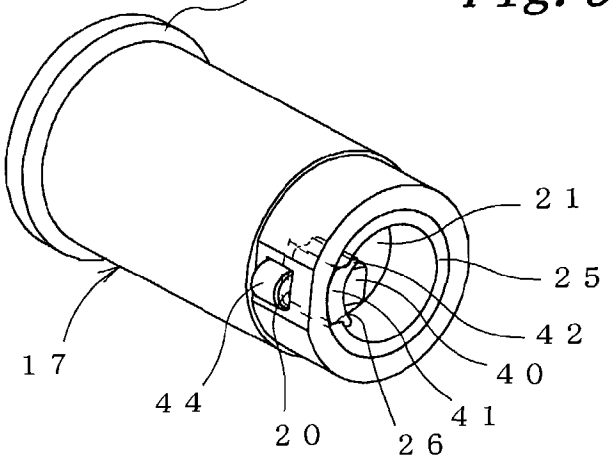
Figure 3C:
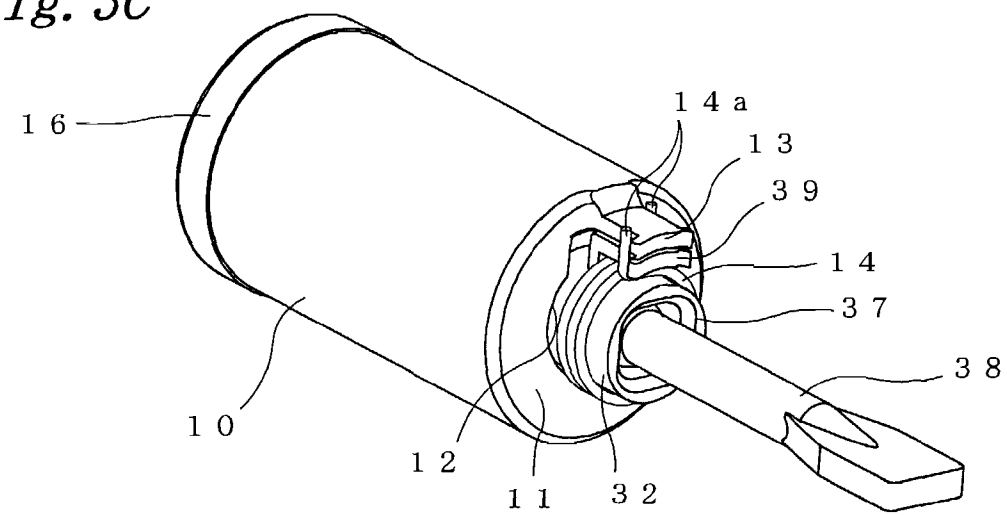

The cylinder 21 shaped like a column is turnably provided in the sleeve 17. In the cylinder 21, specifically, one end to which the cover 16 is fixed is closed, a key insertion hole having a shape corresponding to an authorized key is formed so as to extend from the closed face in the axial direction, and a flange 22 protruding outward is provided. On the cylinder 21, a plurality of (eight, in the embodiment) tumbler insertion holes 23 communicating with the key insertion hole are bored at specified intervals along the axial direction so as to extend in a direction orthogonal to the axial direction from opposed positions on an outer circumferential surface. At one side of the tumbler insertion holes 23 are formed reamed portions 24 into which spring receiver portions 30 of the tumblers 27 and springs 29 are to be inserted. An end of the key insertion hole opposed to the flange 22 is closed, and a cylindrical rotor disposed portion 25 in which the rear rotor 32 that will be described later is disposed is provided on the closed end of the cylinder 21. A portion of outer circumference of the rotor disposed portion 25 is cut out from an end thereof so that a rectangular through hole (i.e. a cut-out portion) 26 extending in the axial direction is formed. As shown in FIG. 3A, the through hole 26 is configured so as to correspond to the installation hole 20 with respect to the axial direction and the radial direction when the cylinder 21 has been installed in the sleeve 17 with use of a well-known positioning mechanism not shown. The through hole 26 is formed so that an opening area of the through hole 26 is larger than that of the installation hole 20.

The tumblers 27 are shaped like plates, and a rectangular keyhole 28 is bored at center of the tumblers 27, as shown in FIGS. 1 and 2A. From one side of each tumbler 27 is protruded the spring receiver portion 30 that is to be in pressure contact with one end of the spring 29. One end of each tumbler 27 with respect to a longitudinal direction thereof configures an engagement protrusion 31 that advances into and engages with the lock groove 18 of the sleeve 17. Insertion of an authorized key into the keyhole 28 causes retreat of the tumbler against a biasing force of the spring 29, with an edge of the keyhole 28 pressed by a key ridge of the key, and releases engagement of the engagement protrusion 31 with the lock groove 18.

As shown in FIGS. 1, 2B, 3B, and 3C, the rear rotor 32 is composed of a mounting portion 33 on which the connecting member 40 that will be described later is mounted and a regulation portion 37 which protrudes to outside from the insertion hole 12 of the holder 10. The mounting portion 33 is turnably provided in the rotor disposed portion 25 of the cylinder 21. On a border of the mounting portion 33 with the regulation portion 37 is provided a flange 34 having a diameter larger than that of the rotor disposed portion 25 of the cylinder 21. In the mounting portion 33 is provided a container portion 35 that is generally shaped like a bracket and that contains the connecting member 40. The container portion 35 is formed with a depth such that a tip end face of the connecting member 40 fully sinks into inside from a surface of the mounting portion 33 with the connecting member 40 retracted. At a bottom of the container portion 35 is provided a fixing portion 36 for a spring 43 which biases the connecting member 40 outward. The regulating part 37 is inserted into the insertion hole 12 of the holder 10 so as to protrude axially outward from the closed portion 11. From a tip of the regulating portion 37 is protruded the paddle 38 connected to the lock mechanism not shown. On the regulating part 37, the spring engaging portion 39 that is generally shaped like a letter "L" and that extends below the spring engagement portion 13 is provided in a position projected outward from the closed portion 11 in a state in which the rear rotor 32 is mounted in the holder 10. A spring 14 is fit on the outer circumference of the regulating portion 37 shaped like a cylinder, and ends 14*a*, 14*a* of the spring 14 are positioned on both sides of both the spring engagement portions 13 and 39. When the rear rotor 32 turns relative to the holder 10, the ends 14*a*, 14*a* of the spring 14 expand outward against a biasing force. Upon release of a force for turning the rear rotor 32, the rear rotor 32 is returned to a predetermined initial position by the biasing force of the spring 14.

The connecting member 40 is provided in the container portion 35 of the rear rotor 32 and is movable in the radial directions between a connected position in which the cylinder 21 and the rear rotor 32 are connected and a non-connected position in which the cylinder 21 and the rear rotor 32 are not connected. When the connecting member 40 is fitted in the through hole 26 of the cylinder 21 that is formed so as to be larger than the installation hole 20, specifically, the connecting member 40 makes a circular section that is generally flush with the outer circumferential surface of the cylinder 21. On the other hand, the connecting member 40 has a circular-arc-like protrusion 41 that fully sinks into the container portion 35 and that is brought into sliding contact with an inner circumferential surface of the cylinder 21 in a state in which the connecting member 40 has been retracted into the container portion 35. On base ends of the circular-arc-like protrusion 41 are provided wing-like portions 42 that engage with edges of the through hole 26 on inner surface side of the cylinder 21. The connecting member 40 is held in the connected position in which the connecting member 40 is connected with the cylinder 21 fitted in the through hole 26, by the biasing force of the spring 43 that is a biasing member fixed to the fixing portion 36 of the rear rotor 32. In the state in which the connecting member 40 has advanced to the connected position, the wing-like portions 42 are in contact with the inner circumferential surface of the cylinder 21 and prevent the circular-arc-like protrusion 41 from being strongly biased against the inner circumferential surface of the sleeve 17, so that the cylinder 21 is not loaded when turning relative to the sleeve 17.

The connection releasing member 44 is composed of a column member that is slightly smaller than the opening length of the installation hole 20 of the sleeve 17 in the circumferential direction, that has a diameter generally as large as a sum of thicknesses of the sleeve 17 and the rotor disposed portion 25 of the cylinder 21, and that is in line contact with the circular-arc-like protrusion 41 of the connecting member 40. The connection releasing member 44 is positioned on the outer circumference of the connecting member 40 in the assembled state. Thus the connection releasing member 44 is pressed through the connecting member 40 by the biasing force of the spring 43 and is fitted into the lock recess 15 of the holder 10. When a force is exerted inward in the radial direction on the connection releasing member 44, the connection releasing member 44 can be moved inward in the radial direction relative to the sleeve 17 against the biasing force of the spring 43 of the connecting member 40. When the sleeve 17 that receives a turning force of the cylinder 21 by virtue of engagement of the tumblers 27 turns in the circumferential direction relative to the holder 10, the connection releasing member 44 is disengaged from the lock recess 15, is pressed by the inner circumferential surface of the holder 10, and is thus moved in the radial direction. Then the connection releasing member 44 presses and moves the connecting member 40 to the non-connected position.

In this cylinder lock configuration, the connecting member 40 that is movable in the radial directions is provided in the container portion 35 of the rear rotor 32, and the connection releasing member 44 that presses the connecting member 40 and moves the connecting member 40 to the non-connected position is provided on the outer circumference of the connecting member 40. Accordingly, the connecting member 40 and the connection releasing member 44 are not required to be positioned at given intervals with respect to the axial direction. As a result, the total length of the cylinder lock and the size of the cylinder lock as a whole can be decreased in comparison with those of the cylinder lock of Patent Document 2. Also, the simplification of components and assembly structure of the cylinder lock improves work efficiency in assembling and leads to cost reduction. Furthermore, the connection releasing member 44 is actuated by the spring 43 that biases the connecting member 40. Thus a spring for biasing the connection releasing member 44 is not required and a number of components can be reduced.

Hereinbelow, operation of the cylinder lock will be described specifically.

In a normal state in which locking is attained by the lock mechanism without insertion of a key into the cylinder 21, the engagement protrusions 31 of the tumblers 27 provided in the cylinder 21 project from the surface by action of the biasing forces of the springs 29 and advance into and engage with the lock grooves 18 of the sleeve 17. Thus the cylinder 21 is held in a state in which the cylinder 21 cannot be turned relative to the sleeve 17.

The connection releasing member 44 provided in the sleeve 17 engages with the lock recess 15 of the holder 10 and the engagement is maintained through the connecting member 40 by the biasing force of the spring 43. In this state, the connecting member 40 is engaged with the through hole 26 of the cylinder 21. Thus the rear rotor 32 is held in a state in which the rear rotor 32 cannot be turned relative to the cylinder 21, and the sleeve 17 is also held in a state in which the sleeve 17 cannot be turned relative to the holder 10.

Figure 4B:
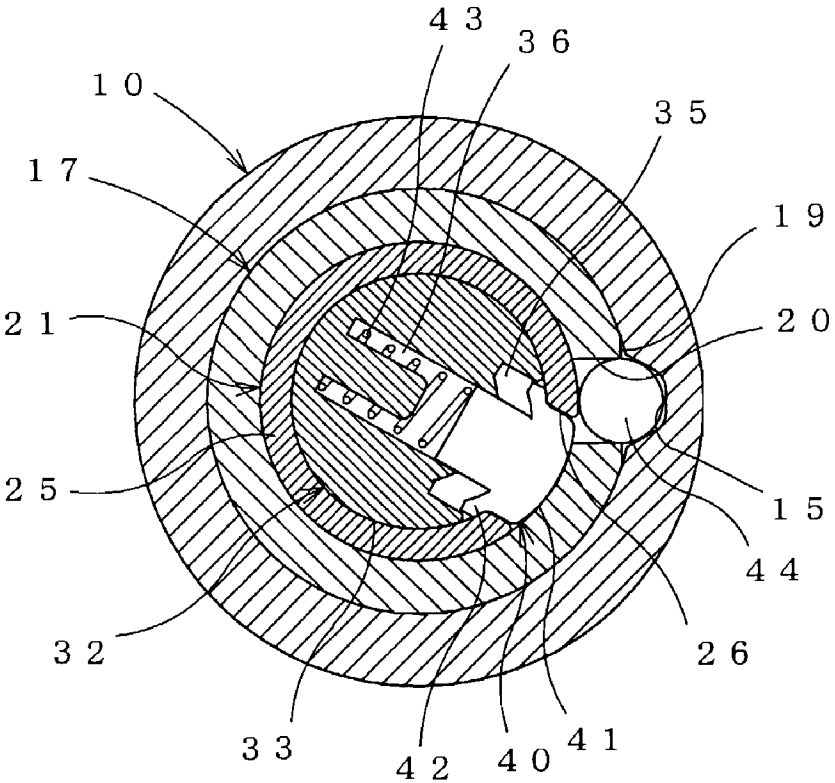
FIGS. 4A and 4B are main-parts sectional views showing an unlocking operation with use of an authorized key.
Figure 4A:
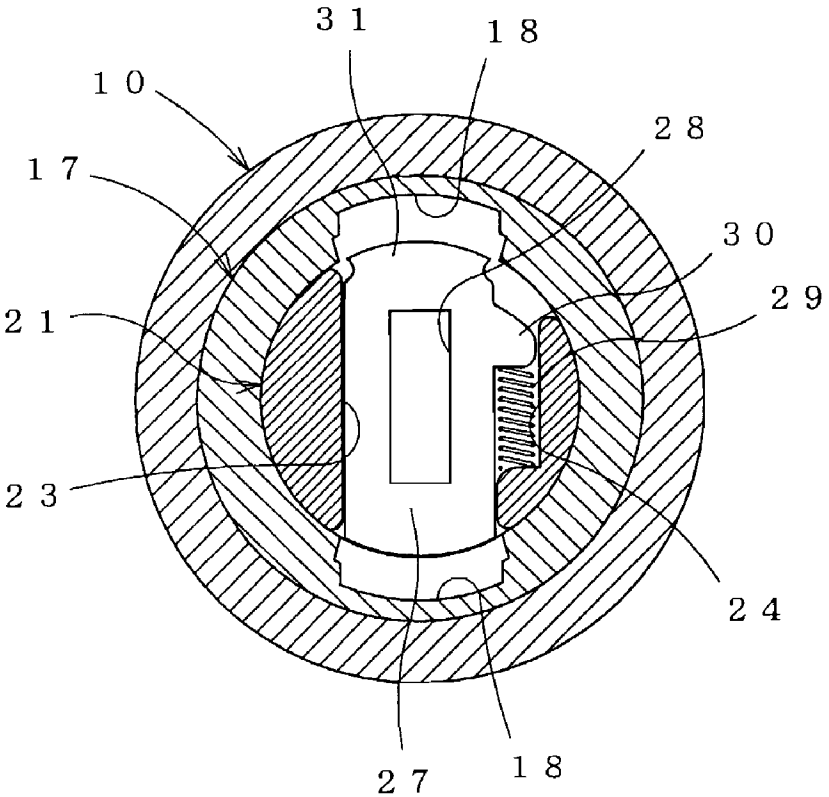

When an authorized key is inserted into the cylinder 21 in the locked state, the authorized key pierces through the keyholes 28 of the tumblers 27, so that the tumblers 27 retreat and sink into the cylinder 21 as shown in FIG. 4A. As a result, the cylinder 21 is made turnable in the circumferential directions relative to the sleeve 17. Then the rear rotor 32 connected through the connecting member 40 to the cylinder 21 is made turnable together with the cylinder 21 relative to the sleeve 17 because the connected state between the cylinder 21 and the rear rotor 32 is maintained. By a turn of the authorized key, accordingly, the paddle 38 provided on the rear rotor 32 can be turned and unlocking operation can be attained.

When the connecting member 40 turns with the cylinder 21, the outer circumference of the cylinder 21 is positioned inside the connection releasing member 44 with respect to the radial direction as shown in FIG. 4B. As a result, the connection releasing member 44 cannot move inward with respect to the radial direction, and a state is maintained in which the connection releasing member 44 is fitted into the lock recess 15 of the holder 10. Therefore, the sleeve 17 is held in the state in which the sleeve 17 cannot be turned relative to the holder 10.

In the embodiment, in this manner, a turn of an authorized key inserted into the cylinder 21 makes only the cylinder 21 and the rear rotor 32 turnable relative to the holder 10 and thus makes an unlocking operation possible.

When a screwdriver, an unauthorized key or the like is inserted into the cylinder 21 in the locked state, it pierces through the keyholes 28 of the tumblers 27. Some tumblers 27 may retreat and sink into the cylinder 21 by chance, but not all of the tumblers. As a result, the cylinder 21 is held in the state in which the cylinder 21 cannot be turned in the circumferential directions relative to the sleeve 17. Then the rear rotor 32 connected through the connecting member 40 to the cylinder 21 is held in the unturnable state because the connected state between the cylinder 21 and the rear rotor 32 is maintained.

With a forcible turn in this state, the turning force of the cylinder 21 is transmitted to the sleeve 17 through engagement of the tumblers 27, and the sleeve 17 turns together with the cylinder 21 relative to the holder 10. That is, the sleeve 17 and the rear rotor 32 turn as one body relative to the holder 10 in synchronization with the turn of the cylinder 21 because the cylinder 21 and the sleeve 17 are connected to each other through the tumblers 27 and because the cylinder 21 and the rear rotor 32 are connected to each other through the connecting member 40.

Figure 5B:
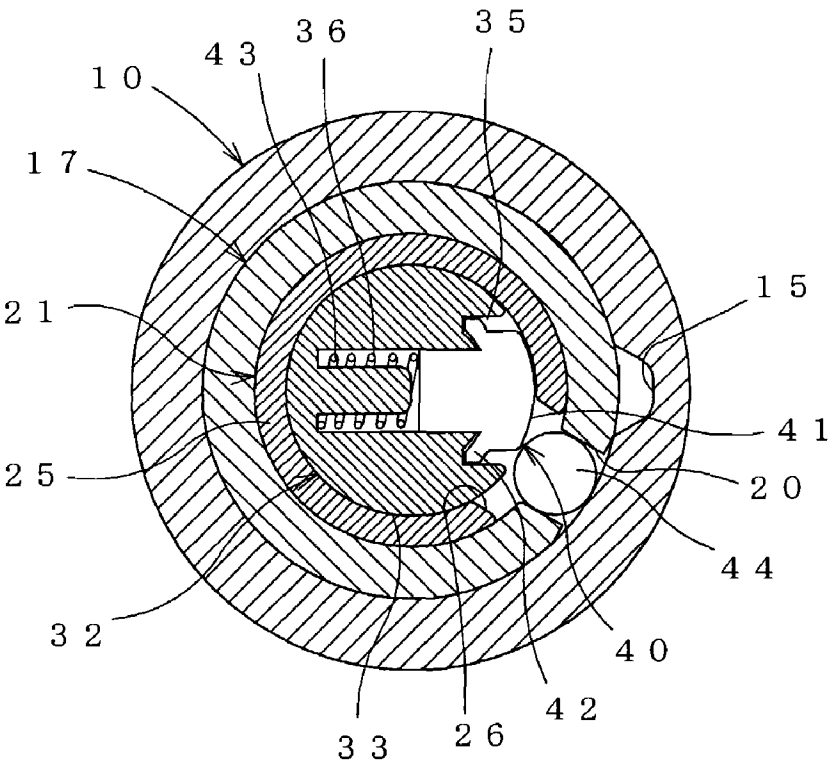
FIGS. 5A and 5B are main-parts sectional views showing an unlocking operation with use of an unauthorized key.
Figure 5A:
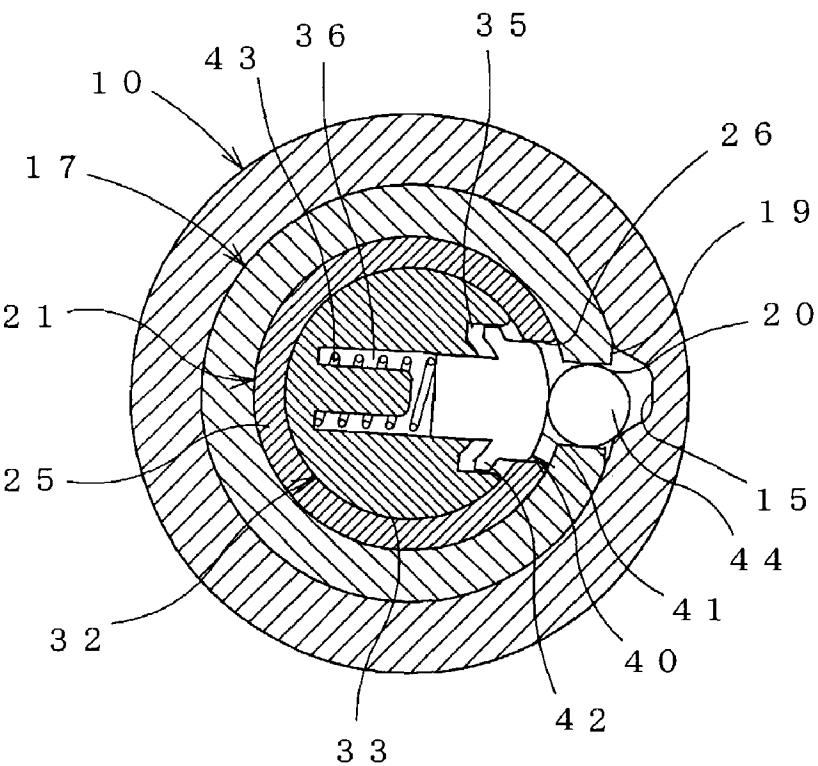

With this action, the connection releasing member 44 provided in the sleeve 17 is disengaged from the lock recess 15 as shown in FIG. 5A. Then the connection releasing member 44 rises onto the inner circumferential surface of the holder 10 and moves radially inward in the installation hole 20, together with the connecting member 40, against the biasing force of the spring 43. Then the connecting member 40 retreats and sinks into the container portion 35 and is shifted from the connected position to the unconnected position with respect to the through hole 26 of the cylinder 21. Consequently, the connection between the cylinder 21 and the rear rotor 32 is released, so that the rear rotor 32 on which the paddle 38 is mounted cannot be turned by a turn of the cylinder 21. The rear rotor 32 is returned (turned) from a position resulting from a slight turn to the initial position by the biasing force of the spring 14, as shown in FIG. 5B.

In event that a forcible turn of the cylinder lock of the embodiment is attempted with insertion of a screwdriver, an unauthorized key or the like as is the case with conventional cylinder locks, the rear rotor 32 connected to the lock mechanism is not turned and slip of the cylinder 21 prevents unauthorized unlocking, as described above.

In an unauthorized unlocking operation, gaps between the tumblers 27 and the lock grooves 18 allow a slight turn of the cylinder 21 relative to the sleeve 17 and a shift between positions of the connecting member 40 and the connection releasing member 44. In accordance with the embodiment, however, such an error can be absorbed because a width of the connecting member 40 is larger than a width of the installation hole 20 of the sleeve 17. Besides, increase in load on occasion of a turn of the sleeve 17 in an authorized unlocking operation can be prevented because the connection releasing member 44 is shaped like a column that can be turned in line contact with the connecting member 40.

Figure 6:
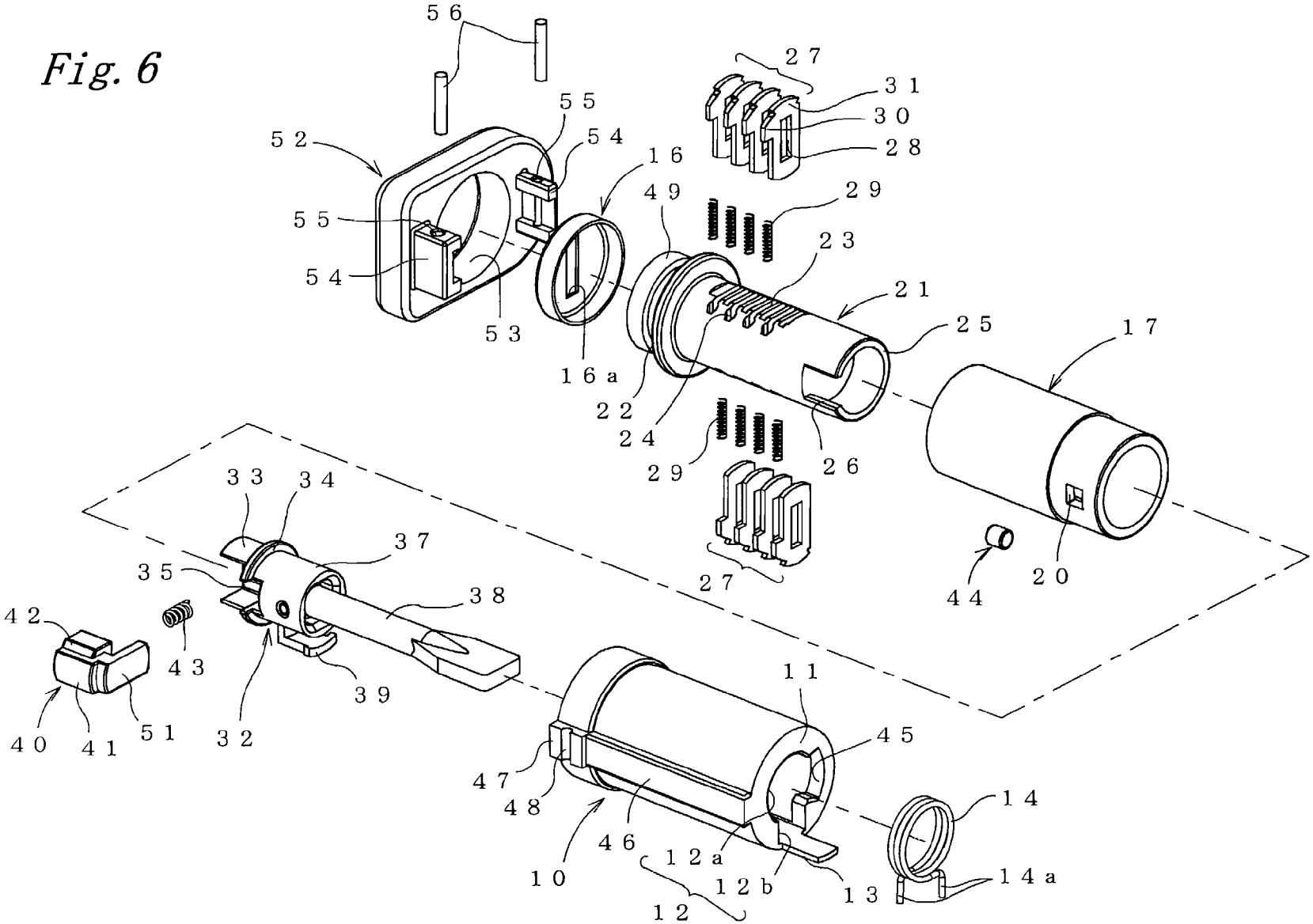
FIG. 6 is an exploded perspective view of a cylinder lock in accordance with a second embodiment of the invention.

FIGS. 6 and 7 show a cylinder lock of a second embodiment. The second embodiment is greatly different from the first embodiment in that a rear rotor 32 disconnected from a cylinder 21 in unauthorized unlocking is locked with respect to a holder 10 so as to be unturnable. As shown in FIG. 6, specifically, the cylinder lock of the second embodiment is composed of the holder 10, a sleeve 17, a cylinder 21, a plurality of tumblers 27, a rear rotor 32, a connecting member 40, and a connection releasing member 44, as is the case with the first embodiment, and is further provided with a protecting member 52 for protecting a front end (on left side in FIG. 6) having a key insertion hole. Hereinbelow, the same configurations as those of the first embodiment will be designated by the same reference numerals and detailed description thereof will be omitted.

In the holder 10 is provided a locked portion 45 that is to be locked by a locking portion 51 of the rear rotor which will be described later and which has reciprocally advanced into an insertion hole 12 formed in a closed portion 11 at one end and shaped like a keyhole. In the embodiment, the locked portion 45 is composed of a cutout that is provided so as to extend in a direction generally orthogonal to an extending direction of a rectangular hole 12*b* of the insertion hole 12. A width of the cutout of the locked portion 45 is set wider than a width of the locking portion 51 that will be described later, in consideration of a range in which the rear rotor 32 slightly turns together with the cylinder 21 in unauthorized unlocking. On a side of the holder 10 opposed to the locked portion 45 with respect to the radial direction, a protrusion 46 is provided for positioning the cylinder lock on a door of a vehicle, a building or the like. There are provided protecting-member mounting portions 47 on a front end of the holder 10, in a part linearly coinciding with the protrusion 46 and in a position opposite to that part. On the protecting-member mounting portions 47 are provided semicircular engagement grooves 48 through which pins 56 for preventing disengagement are to pierce. A cover 16 is not fixed to the holder 10 of the embodiment but is fixed to the cylinder 21 that will be described later.

The sleeve 17 is different from the first embodiment only in that the chamfered portion 19 shown in the first embodiment is not formed in part where a rectangular installation hole 20 in which the connection releasing member 44 is movably installed is formed.

The cylinder 21 is different from the first embodiment only in that a protruded portion 49 on which the cover 16 is mounted is provided on a side of a closed surface at the front end of the cylinder 21 on which a key insertion hole is formed. A quantity of protrusion of the protruded portion 49 is set so that a front end of the protecting member 52 that will be described later is flush with a front end surface of the cover 16 in a state in which the cylinder lock has been assembled.

The tumblers 27 have the same configuration as that of the first embodiment in which the rectangular keyholes 28 are provided.

Figure 7B:
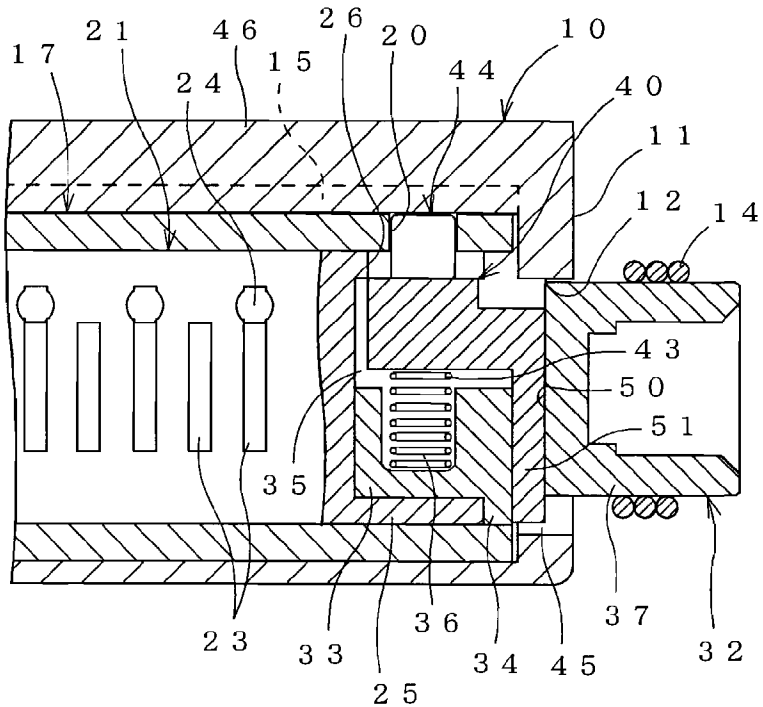
FIGS. 7A and 7B are main-parts sectional views showing actions in an unlocking operation with use of an unauthorized key.
Figure 7A:
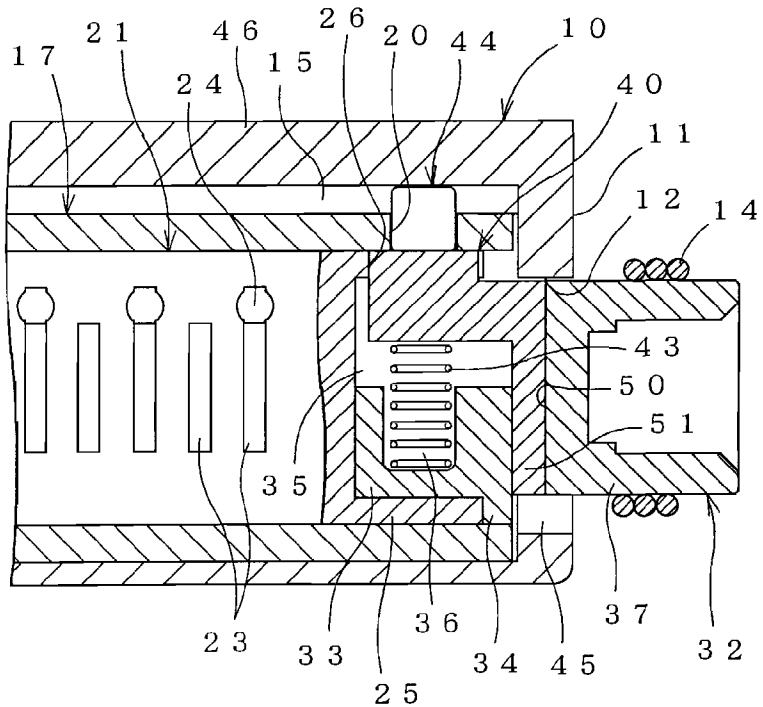

The rear rotor 32 is composed of the mounting portion 33 and the regulating portion 37 as is the case with the first embodiment. On a border between those portions is provided a flange 34 having a diameter smaller than that of an opening (i.e. an open end) of a rotor disposed portion 25 of the cylinder 21. In the mounting portion 33 is provided a container portion 35 that is generally shaped like a bracket and that contains the connecting member 40. The container portion 35 of the embodiment is provided so as to extend beyond the flange 34 to the regulating portion 37 and is configured so that the container portion 35 positioned in the regulating portion 37 is exposed from the cylinder 21 to outside in the assembled state. In the exposed portion, as shown in FIGS. 7A and 7B, is provided a locking-portion through hole 50 that pierces in a radial direction and that corresponds to a locked portion 45 of the holder 10 in the assembled state.

The connecting member 40 is different from the first embodiment only in that a locking portion 51 protruding generally in a shape of letter "L" is provided on one side face thereof, as shown in FIG. 6. The locking portion 51 is inserted into the locking-portion through hole 50 in a state in which the connecting member 40 is installed in the container portion 35. The locking portion 51 is formed with a size such that the locking portion 51 does not protrude from the locking-portion through hole 50 in a connected position in which the cylinder 21 is connected to the rear rotor 32 and such that the locking portion 51 protrudes from the locking-portion through hole 50 in a non-connected position in which the cylinder 21 is not connected to the rear rotor 32.

The connection releasing member 44 has the same configuration as that of the first embodiment which is composed of a column member.

The protecting member 52 is composed of a thick zinc die cast plate generally shaped like an oblong. In center of the protecting member 52 is provided an installation hole 53 into which the protruded portion 49 of the cylinder 21 is inserted. On both sides of the installation hole 53, guides 54 on which the protecting-member mounting parts 47 of the holder 10 are mounted protrude rearward. In the guides 54 are provided pin holes 55 corresponding to the engagement grooves 48 of the holder 10. By piercing of the pins 56 through the pin holes 55, the holder 10 is fixed so that the holder 10 cannot be disengaged.

In the cylinder lock of the second embodiment, a locking action in a state in which no member is inserted into the cylinder 21 and an unlocking action in event that an authorized key is inserted into the cylinder 21 and is turned are the same as those in the first embodiment.

Upon insertion of a screwdriver, an unauthorized key or the like into the cylinder 21 in the locked state, the cylinder 21 is held in a state in which the cylinder 21 cannot be turned relative to the sleeve 17 because not all the tumblers 27 sink, as is the case with the first embodiment, and the rear rotor 32 connected through the connecting member 40 to the cylinder 21 is similarly held in a state in which the rear rotor 32 cannot be turned because the connected state between the cylinder 21 and rear rotor 32 is maintained.

With a forcible turn in this state, the turning force of the cylinder 21 is transmitted to the sleeve 17 through engagement of the tumblers 27, and the sleeve 17 turns together with the cylinder 21 relative to the holder 10. With this action, as shown in FIG. 7B, the connection releasing member 44 provided in the sleeve 17 is disengaged from a state in which the connection releasing member 44 engages with a lock recess 15 as shown in FIG. 7A. Then the connection releasing member 44 rises onto the inner circumferential surface of the holder 10 and moves radially inward in the installation hole 20, together with the connecting member 40, against the biasing force of a spring 43.

Thus the connecting member 40 retreats and sinks into the container portion 35 and is shifted from the connected position to the unconnected position with respect to a through hole 26 of the cylinder 21. Consequently, the connection between the cylinder 21 and the rear rotor 32 is released, so that the rear rotor 32 on which a paddle 38 is mounted cannot be turned with a turn of the cylinder 21. Also, the locking portion 51 of the connecting member 40 protrudes from the locking-portion through hole 50 of the rear rotor 32 and advances into the locked portion 45 of the holder 10, so that the rear rotor 32 is brought into the locked state in which the rear rotor 32 cannot singly be turned. The rear rotor 32 is returned (turned) from a position resulting from a slight turn to the initial position by the biasing force of the spring 14.

In event that a forcible turn is attempted with insertion of a screwdriver, an unauthorized key or the like in the cylinder lock of the second embodiment, the rear rotor 32 connected to the lock mechanism is not turned and slip of the cylinder 21 prevents unauthorized unlocking, as is the case with the first embodiment. Thus the same functions and the same effects can be achieved.

In accordance with the second embodiment, furthermore, the rear rotor 32 can be brought into the locked state in which the rear rotor 32 cannot be turned, when the cylinder 21 is slipped by unauthorized unlocking. In event that unlocking of the cylinder lock of the embodiment installed in a vehicle is attempted with use of an unauthorized key or a screwdriver and that a turn of the rear rotor 32 is attempted with use of some tools inserted into a gap in a window or the like, for example, the turn of the rear rotor 32 can reliably be prevented. In other words, the cylinder lock of the first embodiment, in which the rear rotor 32 can singly be turned in unauthorized unlocking, can achieve sufficient functions and effects for buildings in which any manipulation cannot be carried out from sites other than the key insertion hole. For vehicles in which manipulation to the rear rotor 32 can be carried out from sites other than the key insertion hole, however, the locking structure is preferably provided so that the rear rotor 32 cannot be singly turned in unauthorized unlocking, as in the second embodiment.

The cylinder locks of the invention are not limited to configurations of the embodiments and various modifications can be done.

For example, the connection releasing member 44 is composed of a column member that is in line contact with the connecting member 40. The connection releasing member 44, however, may be composed of a rotatable spherical member that is in point contact with the connecting member 40. This configuration further reduces a load caused by a turn of the sleeve 17 relative to the holder.

What is claimed is:

1. A cylinder lock comprising:

a cylindrical sleeve turnably disposed in a holder, the cylindrical sleeve comprising lock grooves formed on an inner circumferential surface and an installation hole at a first end;

a cylinder turnably disposed in the cylindrical sleeve, the cylinder comprising a plurality of tumbler insertion holes extending in a direction orthogonal to a longitudinal axis of the cylinder, the cylinder further comprising an open end and a cut-out portion provided in a sidewall of the cylinder;

a plurality of tumblers reciprocally disposed in the tumbler insertion holes, wherein the plurality of tumblers are engagable with the lock grooves in an advanced position and disengageable from the lock grooves in a retracted position, wherein the retracted position corresponds to insertion of an authorized key;

a rear rotor at least partially disposed in the open end of the cylinder and turnable in the cylinder, the rear rotor comprising a container portion corresponding to the cut-out portion in the cylinder;

a connecting member disposed in the container portion and movable in radial directions between a connected position in which the rear rotor and the cylinder are connected by the connecting member protruding into the cut-out portion of the cylinder and a non-connected position in which the connecting member disengages from the cut-out portion of the cylinder such that the rear rotor and the cylinder are disconnected; and a connection releasing member positioned on an outer circumference of the connecting member and movable in radial directions within the installation hole of the cylindrical sleeve, the connection releasing member being operable to travel radially so as to displace the connecting member to the non-connected position when the cylindrical sleeve turns relative to the holder wherein a biasing member for biasing the connecting member toward the connected position is provided in the container portion for the rear rotor, and wherein the connection releasing member is engaged by the connecting member and receives a biasing force from the biasing member such that the connecting member is engaged with the cutout portion and wherein the connection releasing member is held in a lock recess formed on an inner circumferential surface of the holder when the connecting member is in the connected position.

2. A cylinder lock as claimed in claim 1, wherein the container portion extends beyond the cylinder in a direction of the longitudinal axis of the cylinder, wherein a locking-portion through hole is provided in an exposed part of the container portion, and wherein a locking portion is provided on the connecting member, the locking portion being movable to protrude from the locking-portion through hole and engage a locked portion of the holder when the connecting member moves to the non-connected position.

3. The cylinder lock of claim 1, wherein the connecting member is movable to the non-connected position when the cylindrical sleeve receives a turning force of the cylinder through an engagement of the tumblers with the lock grooves.

4. The cylinder lock of claim 1, wherein the connecting member is movable to the non-connected position when the cylindrical sleeve turns relative to the holder.

5. The cylinder lock of claim 4, wherein the cylinder is movable relative to the rear rotor when the connecting member is in the non-connected position.

6. The cylinder lock of claim 1, wherein the cylinder is movable relative to the rear rotor in a circumferential direction when the connecting member is in the non-connected position.

7. The cylinder lock of claim 1, wherein the cylinder has an inner cylinder periphery, wherein the sleeve has an outer sleeve periphery, and wherein the connection releasing member is disposed entirely between the inner cylinder periphery and the outer sleeve periphery when the connecting member is in the non-connected position.

8. The cylinder lock of claim 1, wherein the cylinder is movable relative to the rear rotor when the connecting member is in the non-connected position.

9. A cylinder lock comprising:

a cylindrical sleeve turnably disposed in a holder, the cylindrical sleeve comprising lock grooves formed on a inner circumferential surface;

a cylinder turnably disposed in the cylindrical sleeve, the cylinder comprising a plurality of tumbler insertion holes extending in a direction orthogonal to a longitudinal axis of the cylinder;

a plurality of tumblers reciprocally disposed in the tumbler insertion holes, wherein the plurality of tumblers are engagable with the lock grooves in an advanced position and disengagable from the lock and grooves in a retracted position, wherein the retracted position corresponds to insertion of an authorized key;

a rear rotor at least partially disposed in the cylinder and turnable in the cylinder, the rear rotor comprising a container portion disposed in the cylinder;

a connecting member disposed in the container portion and movable in radial directions between a connected position in which the rear rotor and the cylinder are connected and a non-connected position in which the cylinder is movable relative to the rear rotor; and a connection releasing member positioned on an outer circumference of the connecting member and movable in radial directions relative to the cylindrical sleeve, the connection releasing member being operable to travel radially so as to displace the connecting member to the non-connected position when the cylindrical sleeve turns relative to the holder at the end of the claim, delete the period and insert wherein a biasing member for biasing the connecting member toward the connected position is provided in the container potion for the rear rotor, and wherein the connection releasing member is engaged by the connecting member and receives a biasing force from the biasing member such that the connecting member is engaged with the cylinder, and wherein the connection releasing member is held in a lock recess formed on an inner circumferential surface of the holder when the connecting member is in the connected position.

10. A cylinder lock as claimed in claim 9, wherein the container portion extends beyond the cylinder in a direction of the longitudinal axis of the cylinder, wherein a locking-portion through hole is provided in an exposed part of the container portion, and wherein a locking portion is provided on the connecting member, the locking portion being movable to protrude from the locking-portion through hole and engage a locked portion of the holder when the connecting member moves to the non-connected position.

11. The cylinder lock of claim 9, wherein the connecting member is movable to the non-connected position when the cylindrical sleeve receives a turning force of the cylinder through an engagement of the tumblers with the lock grooves.

12. The cylinder lock of claim 9, wherein the connecting member is movable to the non-connected position when the cylindrical sleeve turns relative to the holder.

13. The cylinder lock of claim 12, wherein the cylinder is movable relative to the rear rotor when the connecting member is in the non-connected position.

14. The cylinder lock of claim 9, wherein the cylinder is movable relative to the rear rotor in a circumferential direction when the connecting member is in the non-connected position.

15. The cylinder lock of claim 9, wherein the cylinder has an inner cylinder periphery, wherein the sleeve has an outer sleeve periphery, and wherein the connection releasing member is disposed entirely between the inner cylinder periphery and the outer sleeve periphery when the connecting member is in the non-connected position.

16. The cylinder lock of claim 9, wherein the cylinder is movable relative to the rear rotor when the connecting member is in the non-connected position.

* * * * *